US007036815B2

(12) United States Patent
Yamamoto

(10) Patent No.: US 7,036,815 B2
(45) Date of Patent: May 2, 2006

(54) SHEET MATERIAL CONVEYING APPARATUS, RECORDING APPARATUS AND RECORDING SYSTEM

(75) Inventor: Kosuke Yamamoto, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 168 days.

(21) Appl. No.: 10/614,024

(22) Filed: Jul. 8, 2003

(65) Prior Publication Data

US 2004/0012143 A1 Jan. 22, 2004

(30) Foreign Application Priority Data

Jul. 17, 2002 (JP) ..... 2002-208144

(51) Int. Cl.
*B65H 3/52* (2006.01)

(52) U.S. Cl. ..... 271/124; 271/125

(58) Field of Classification Search ..... 271/124, 271/125; 347/104

See application file for complete search history.

(56) References Cited

U.S. PATENT DOCUMENTS 5,016,866 A * 5/1991 Takahashi ..... 271/122
5,651,542 A * 7/1997 Yamauchi et al. ..... 271/122
6,540,222 B1 * 4/2003 Araki et al. ..... 271/122
6,585,252 B1 * 7/2003 Russo et al. ..... 271/122
6,585,253 B1 * 7/2003 Miki ..... 271/125

FOREIGN PATENT DOCUMENTS

JP 6341335 * 2/1988
JP 5147767 * 6/1993

* cited by examiner

*Primary Examiner*—David H. Bollinger
(74) *Attorney, Agent, or Firm*—Fitzpatrick, Cella, Harper & Scinto

(57) ABSTRACT

A sheet material conveying apparatus is provided with retard levers for supporting a retard roller shaft, which are rotative centering on the central axis of rotation so as to press the retard roller to a conveying roller. Retard pressing springs are hooked to the spring latches of the retard levers, and the hooks of a slider. When the limiter gear of a torque limiter rotates, the tightening force exerted by a stepped spring against an inner race is caused to change, thus changing the rotating-load torque of the retard roller. A motor enables the limiter gear to rotate, while moving the slider up and down. In this way, it is made possible to change the rotating load torque of the retard roller, while changing the pressurized contact force of the retard roller against the conveying roller. With the structure thus arranged, it is attempted to make the life of rollers longer, and to prevent the occurrence of double feeding of sheet material.

15 Claims, 8 Drawing Sheets

SHEET MATERIAL CONVEYING APPARATUS, RECORDING APPARATUS AND RECORDING SYSTEM

BACKGROUND OF THE INVENTION

1. Field of the Invention

The present invention relates to a sheet material conveying apparatus for conveying sheet material one by one by separating them from those stacked and held. The invention also relates to a recording apparatus that records on the sheet material serving as a recording medium, and a recording system for controlling the recording apparatus as well.

2. Related Background Art

Conventionally, and generally, there have been in wide use the ink jet recording apparatus, the laser beam printer, and the like, which perform recording by means of ink jet recording process or electronic photographing process by conveying only one sheet of recording medium separated from a stack of plural sheets after being set on a sheet-feeding tray or a sheet feeding cassette.

Also, along with the advancement of the ink jet recording process or the electronic photographing process, it has become possible to provide the output in as high quality as almost a photograph.

On the recording medium side, too, various and many kinds of specially treated medium are available on the market, such as the one having an ink acceptance layer on the surface of the medium in order to make clear color reproduction or having a glossy layer in order to produce the sense of glossiness.

On the other hand, the copying sheet used mainly for text recording or the like, that is, the so-called normal medium, is still in wide use in terms of quantity.

To meet the requirement for the convenient use of a recording apparatus, there exist recording apparatuses capable of handling both the specially treated medium and the normal medium overwhelmingly.

As the separation mechanism for separating and feeding these various and many kinds of recording medium one by one, the following typical ones are available:

1) Nail separation
2) Inclined plane separation
3) Frictional separation
4) Retard separation.

The nail separation listed as Item 1) above is arranged to perform the separation by bending the edge portion of medium so as to enable it to get over the nail. Therefore, if the medium has thickness beyond a certain extent, a large conveying power is required for bending it. In the sense of practicability, therefore, this type is mainly used for separating the normal medium.

The inclined plane separation listed as Item 2) above is arranged to perform the separation by favorably setting the relations of the magnitude difference among the resistance of the recording medium when it passes the inclined plane upward, the friction between one sheet of medium and another, and the conveying power given to the medium for the intended separation.

The frictional separation listed as Item 3) above is a method for preventing double feeding by use of a member having higher friction coefficient than that of the recording medium, which is called a separation pad (friction pad). This method depends on the friction force between the separation pad and recording medium in order to interrupt the progress of the recording medium for the prevention of double feeding, which makes it difficult to select a separation pad effectively usable for various and many kinds of recording medium. Moreover, the friction force between the separation pad and medium tends to vary depending on the environmental conditions. Thus, there is a limit to the reliability of separation performance.

The retard separation listed as Item 4) above is formed by a driving roller that feeds a recording medium; a driven roller, which is in contact with the driving roller under pressure exerted by a constant load to follow the rotation thereof; and a torque limiter that provides the driven roller with the torque of rotational load when it rotates in the conveying direction of recording medium. In accordance with this method, the torque of rotational load generated by the torque limiter contributes to interrupting the progress of recording medium for the prevention of double feeding. In other words, the force needed for holding the recording medium back, which is converted from the torque of the rotational load provided by the torque limiter, is set at a value larger than the friction force between adjacent mediums when plural sheets thereof are put into the gap between the driving roller and the driven roller. Thus, those sheets of medium are not allowed to pass as they are in overlapped condition. The sheets are made apart between them, and only one sheet is separated from others.

The superiority of this method is that the force needed for holding the medium back can be controlled constantly by means of the torque of rotational load provided by the torque limiter. Therefore, unlike the inclined plane separation or the frictional separation, there is no difference resulting from the kinds of medium as to the resistance when being separated. Also, among some others, this method has an advantage that it is not easily influenced by the environmental conditions.

Now, in conjunction with FIG. 8, the description will be made of the conventional example of the retard type feed and separation device.

This sheet-feeding and separation device conveys a medium 102 to an image-forming portion (not shown). The sheet-feeding and separation device 101 is provided with a pickup roller 105 that feeds and conveys a medium 102 on the uppermost layer one by one from the storing device 103 where the plural number of mediums 102 is stacked; a driving roller 106 that conveys the medium 102 thus fed and conveyed by the pickup roller 105 to the image-forming portion (not shown); the retard roller 107, which is positioned to face the driving roller 106 and separate one sheet of medium by rotating in the direction opposite to the driving roller 106 when the fed and conveyed medium 102 is in plural sheets; and a conveying roller pair 9 arranged in front of the image-forming portion. Also, for the area where the recording medium passes, guides 111 and 112 are arranged to guide the medium 102.

The driving roller 106 and the retard roller 107 are driven by the driving power transmission device 113, which is shown in FIG. 9. The driving power transmission device 113 comprises the driving roller shaft 115, which axially supports the driving roller 106; the retard roller shaft 116, which axially supports the retard roller 107; and the retard roll driving shaft 117, which is connected to the retard roller shaft 116. The retard roller shaft 116 is supported by a supporting member (not shown), which swings freely, to be able to be in contact with or away from the driving roller shaft 115 in parallel thereto. Also, a coupling 119 and a torque limiter 120 are arranged between the retard roller shaft 116 and the retard roller-driving shaft 117. Further, at the end portion of the driving roller 115, there is arranged a clutch 122 to transmit the driving power, which is transmitted from a driving source (not shown) through a driving belt 121, to the driving roller 115. Also, between the driving roller 115 and the retard roller-driving shaft 117, a retard-driving belt 123 is tensioned around to transmit the driving power, which is transmitted from the driving roller 115, to the retard roller-driving shaft 117. In this respect, even if the retard roller 107 is displaced, the coupling 119 exists in order to transmit the driving power from the retard roller-driving shaft 117 to the retard roller shaft 116.

When the medium 102 is conveyed by the driving transmission device 113 one by one in the sheet-feeding direction (direction indicated by arrow b in FIG. 8 and FIG. 9), the retard roller 107 follows the rotation of the driving roller 115 in the direction opposite to the direction of the rotational driving of the retard roller driving shaft 117, because the torque limiter 120 is idle in rotation.

Also, when plural sheets of medium 102 are put into feeding, the torque limiter 120 is not idle, and the retard roller 107 rotates in the same direction of the direction of the rotational driving of the retard roller driving shaft 117, because the friction force exerted between plural sheets of medium is smaller than the friction force between the retard roller 107 and the medium 102. In this manner, only the uppermost medium is separated from the plural sheets of medium 102 put into feeding.

Here, as described above, the transmission of driving power to the retard roller 107 is not necessarily needed. Only with the structure having the torque limiter 120, the separation device can be formed.

Next, dynamically, the description will be made of the conditions that may satisfy the sheet feeding and separation of recording medium 102 in the sheet-feeding and separation device 101 structured as described above. Here, the symbols used for this description will be defined as follows:

Symbols

μ1•2: friction coefficient between paper sheets of the 1st and 2nd sheets

μ2•3: friction coefficient between paper sheets of the 2nd and 3rd sheets

μB•c: friction coefficient between the backside of paper sheet and the retard roller (c)

μF•a: friction coefficient between the front side of the paper sheet and the feed roller (a)

μF•b: friction coefficient between the front side of the paper sheet and the feed roller (b)

P: the pressing force of the retard roller

N: the pressing force exerted by the pressure plate to the feed roller

Tc: the free-running torque of the retard roller (the maximum torque generated)

rc: the radius of the retard roller

FIG. 10 is a view that shows the dynamic model in the case where only one sheet enters the separating portion. FIG. 11 is a view that shows the dynamic model in which two sheets enter the separating portion. In FIGS. 10 and 11, the recording surface (the surface side) is on the upper side, and the backside is on the lower side, respectively.

In FIG. 10, the following two conditional expressions are established:

The condition under which the first sheet is conveyed:

$$\mu F\bullet b\times P+\mu F\bullet a\times N>Tc/rc+\mu 1\bullet 2\times N$$

In other words, $$P>Tc/(\mu F\bullet b\times rc)-N\times(\mu F\bullet a-\mu 1\bullet 2)/\mu F\bullet b \quad (1)$$

The condition under which the retard roller (c) generates the free-running torque without sliding:

$$\mu B\bullet c\times P>Tc/rc$$

In other words, $$P>Tc/(rc\times\mu B\bullet c) \quad (2)$$

Also, in FIG. 11, the following separating conditions are established:

The balanced force exerted on the second sheet:

$$\mu 1\bullet 2\times P+\mu 1\bullet 2\times N=\mu 2\bullet 3\times N+Rc \quad (3)$$

The condition under which the retard roller (C) stops:

$$Rc>Tc/rc \quad (4)$$

The condition under which the first sheet is separated from the second sheet in accordance with the expressions (3) and (4):

$$\mu 1\bullet 2\times P+\mu 1\bullet 2\times N<\mu 2\bullet 3\times N+Tc/rc \quad (5)$$

In the expression (5), given μ1•2=μ2•3, the conditional expression becomes as follows:

Separating condition:

$$\mu 1\bullet 2\times P<Tc/rc$$

In other words, $$P<Tc/(rc\times\mu 1\bullet 2) \quad (6)$$

FIG. 12 is a view that the aforesaid conditions (1), (2), and (6) are represented in the form of a graph with the pressing force P of the retard roller 7 and the free-running torque Tc of the torque limiter 20 being given as parameters.

In FIG. 12, the portion indicated by slanted lines is the normal feed area. From the representation of FIG. 12, it is understandable that the normal feed area becomes wider if the sheet-feeding conditions are set under the directional condition (toward the upper right in FIG. 12) in which both the pressing force P of the retard roller and the free-running torque Tc of the retard roller are made larger.

However, the recording apparatus provided with the conventional retard roller-separation described above is encountered with the following drawback:

Firstly, as described above, the normal feed area becomes wider if the sheet-feeding conditions are set under the directional condition (toward the upper right in FIG. 12) in which both the pressing force P of the retard roller and the free-running torque Tc of the retard roller are made larger.

However, under such condition, it becomes easier for the recording medium to promote the surface friction of the retard roller, and the retard roller tends to suspend the generation of the free running torque in a short period of time, which may bring about the drawback that the normal feed is disabled eventually.

Secondly, in order to avoid the drawback described in the preceding paragraph, the sheet-feeding conditions are set under the condition in the direction (toward the lower left in FIG. 12) in which the pressing force P of the retard roller and the free-running torque Tc of the retard roller are both made smaller. Here, as long as the friction coefficient between each roller and the medium is significantly larger than the friction coefficient between the adjacent mediums themselves, there occurs no problem. However, in the case of glossy sheets where the difference in friction coefficient is very small between those between each roller and the medium, and the mediums themselves, it is inevitable to use the narrower area of the normal feed area shown in FIG. 12, which is fundamentally narrow as a whole. As a result, when being fed, double feeding tends to occur eventually. Particularly, in the case of the ink jet recording apparatus where it is necessary to feed and convey various and many kinds of medium, this harmful effect may take place often.

As described above, it is very difficult to set the sheet-feeding condition under which all the kinds of mediums can be fed and conveyed stably, and the condition should be set at the sacrifice of some other medium, one kind or another.

SUMMARY OF THE INVENTION

Now, therefore, the present invention is designed to solve the problems discussed above. It is an object of the invention to provide a sheet material conveying apparatus, a recording apparatus, and a recording system that can prevent the occurrence of double feeding of sheet material, while maximizing the life of the rollers.

For the achievement of the aforesaid object, the sheet material conveying apparatus of one aspect of the invention is provided with sheet material holing means for stacking and holding plural sheets of recording material, a driving roller for feeding and conveying the sheet material, and a driven roller to be in contact with the driving roller under pressure exerted by a constant load to follow the rotation thereof, to convey sheet material one by one after separating it by the driving roller and the driven roller from those stacked and held by sheet material holding means, comprises a torque limiter having means for changing load torque to provide rotating-load torque when the driving roller rotates in the conveying direction of the sheet material, and to change the rotating-load torque thus generated, and operating means capable of operating the sheet material conveying means from the outside for controlling the rotating-load torque generated by the load torque changing means.

The sheet material conveying apparatus of the present invention structured as described above is capable of changing the rotating-load torque so as to be in agreement with the optimal condition of conveyance, which is changeable depending on the kind of sheet material and other factors, thus making it possible to materialize the sheet material conveying apparatus, which is able to convey various kinds of many sheet materials stably.

In accordance with the invention, it is made possible to select plural steps of rotating-load torque by operating means. Therefore, the rotating-load torque can be selected corresponding to the condition of the kind of sheet material and others.

In accordance with the invention, the lever, which is movable to plural positions, is provided as operating means for selecting the rotating-load torque corresponding to the conditions of the kind of sheet material and others.

In accordance with the invention, a torque limiter comprises an inner race shaft that forms a part of a driven roller shaft; a spring wound around the outer circumference of the inner race shaft; and means for changing load torques provided with a first spring-end fixing portion that fixes one end of the spring, and a second spring-end fixing portion that fixes the other end of the spring, being structured to rotate the second spring-end fixing portion by the rotation of its own with the inner race shaft as the center of rotation. Then, the arrangement is made to make it possible to rotate the means for changing load torques by use of operating means. Therefore, by changing the tightening force of spring, the rotating-load torque can be changed.

In accordance with the invention, means for changing load torques is provided with a first actuator that provides rotational force, and a first driving transmitting means that transmits the driving power of the first actuator to the means for changing load torques. Thus, with the actuator being energized, it is possible to change the rotating-load torques.

In accordance with the invention, means for changing loads, which changes the contact load between the driving roller and driven roller, is provided to make it possible to change the contact load in addition to the rotating-load torque by controlling with operating means the pressurized contact load generated by the means for changing loads so as to be in agreement with the optimal condition of conveyance that may change depending on the kinds of sheet material and other factors.

In accordance with the invention, operating means is arranged to be able to select the combinations between plural steps of rotating-load torques and pressurized contact loads. Then, the rotating-load torque can be selected corresponding to the conditions of the kind of recording medium and other factors.

In accordance with the invention, the structure is arranged so that means for changing loads is provided with the pressing spring that presses the driving roller and driven roller to be in contact with each other under pressure, and means for changing the loads to be generated by the pressing spring. As a result, it becomes possible to change the rotating-load torques and pressurized-contact loads to be in agreement with the optimal condition of conveyance that may change depending on the kind of sheet material and other factors.

In accordance with the invention, the structure is arranged so that means for changing loads is provided with a second actuator that gives driving power, and second driving transmitting means that transmits the driving power of the second actuator to the means for changing loads. Therefore, with each of the actuators being energized for driving, it is possible to change the rotating-load torques and the pressurized-contact loads.

In accordance with the invention, a first actuator and a second actuator are shared for use. Therefore, when energizing the actuator for driving, it is possible to change the rotating-load torque and the pressurized-contact load.

In accordance with the invention, a recording apparatus provided with an ink jet recording head for discharging ink, which records recording information by recording means on a sheet material serving as a recording medium, comprises a sheet material conveying apparatus of the present invention, and means for changing distances that changes the distance between the surface of the ink jet head facing the surface of the recording medium where recording is being made. Then, operating means controls the means for changing distances.

The recording apparatus of the present invention thus structured makes it possible to set the optimal rotating-load torque, pressurized-contact load, and distance to the surface of the recording medium in accordance with the kind of recording medium to be used.

In accordance with the invention, a recording system of the present invention, which controls recording by the recording apparatus of the present invention, comprises a host apparatus that transmits recording commands to the recording apparatus; designating means that designates the kind of recording medium on the host apparatus; transmitting means that transmits to the recording apparatus the information of recording medium thus designated; and controlling means that controls the rotating-load torque generated by means for changing load torques in accordance with the information of the recording medium thus transmitted.

The recording system of the present invention thus structured makes it possible to set the rotating-load torque on the host apparatus in accordance with the medium designation.

In accordance with the invention, controlling means controls the pressurized-contact load provided by means for changing loads, thus making it possible to set on the host apparatus the rotating-load torque and the pressurized-contact load in accordance with the medium designation.

DETAILED DESCRIPTION OF THE PREFERRED EMBODIMENTS

Now, with reference to the accompanying drawings, the description will be made of the embodiments in accordance with the present invention.

First Embodiment

Figure 1:
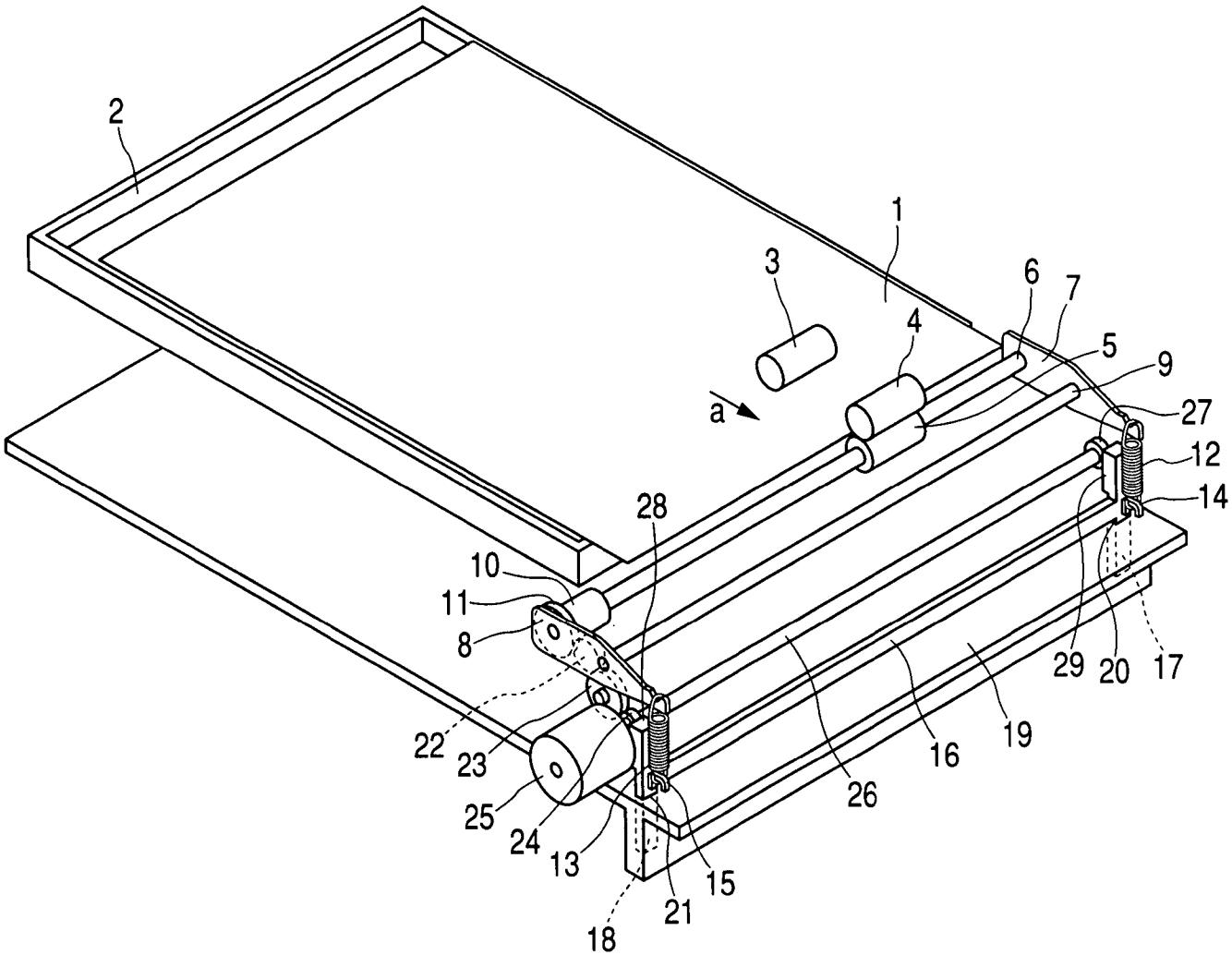
FIG. 1 is a perspective view that shows a recording apparatus in accordance with a first embodiment of the present invention.

FIG. 1 is a perspective view that shows the entire body of a recording apparatus in accordance with the present embodiment.

The sheet-feeding cassette 2, which stores sheets 1 serving as recording medium, is held at a position as shown in FIG. 1 by supporting means (not shown), and approximately 150 sheets 1 can be set in the sheet-feeding cassette 2. A sheet-feeding roller 3 rotates to feed and convey the sheet 1 in the direction indicated by an arrow a by use of driving means and driving transmission means (not shown). Also, a pressure plate (not shown) is arranged in the sheet-feeding cassette 2, which presses all the sheets upward when being fed so that the uppermost sheet 1 is enabled to be in contact with the sheet-feeding roller 3. After this contact, the sheet-feeding roller 3 rotates to feed the sheet 1. A conveying roller 4 rotates in the same direction as the sheet-feeding roller 3 by driving means and driving transmission means (not shown). Rubber is wound around the surface of the conveying roller 4. Rubber is also wound around the surface of a retard roller 5. A retard roller shaft 6 is arranged to be extended in the widthwise direction of the sheet 1. The retard levers 7 and 8, which support the left and right ends of the retard shaft 6, respectively, are supported by side plates (not shown), and structured to be freely rotative centering on a rotation-center shaft 9. The upper parts of retard pressure springs 12 and 13 are hooked to the spring latches of the retard levers 7 and 8, respectively. The lower parts thereof are hooked to the hooks 14 and 15. The spring hooks 14 and 15 are integrally formed with a slider 16. The slider 16 is provided with two sliding portions 17 and 18. The sliding portions 17 and 18 are fitted into the slide holes 20 and 21 of a base 19 so as to be linearly movable up and down. As a result, the entire body of the slider 16 can move up and down. In the state shown in FIG. 1, these two springs are charged, and the retard levers 7 and 8 are given load in the clockwise direction. With such load, the retard roller 5 is pressed to be in contact with the conveying roller 4 with 2.9 N in accordance with the present embodiment. In this state, the retard roller 5 follows the rotation of the conveying roller 4. The retard roller shaft 6 is also allowed to rotate together with the retard roller 5. The retard roller shaft 6 is inserted into the inside of a torque limiter 10, which functions to give a load torque of approximately 0.03 N•m when the retard roller 5 follows the rotation of the conveying roller 4.

A limiter gear 11 forms a part of the torque limiter 10. The limiter gear 11 is connected to a motor gear 24 by way of an idler gear 23 arranged through a supporting plate (not shown) fixed to the idler gear 22, which is fixed to the retard lever 8, and to the base 19 as well. The motor gear 24 is fixed to the rotational shaft of a motor 25. Further, coaxially with the rotational shaft of motor 25, an extension shaft 26 is fixed through a coupling (not shown), and on the opposite side of the extension shaft 26, there is provided a gear 27 having the same configuration as the motor gear 24. When the motor 25 is energized, the motor gear 24 and the gear 27 are allowed to rotate together. The details of the connecting portion of these gears will be described hereunder in conjunction with FIG. 2.

Figure 2:
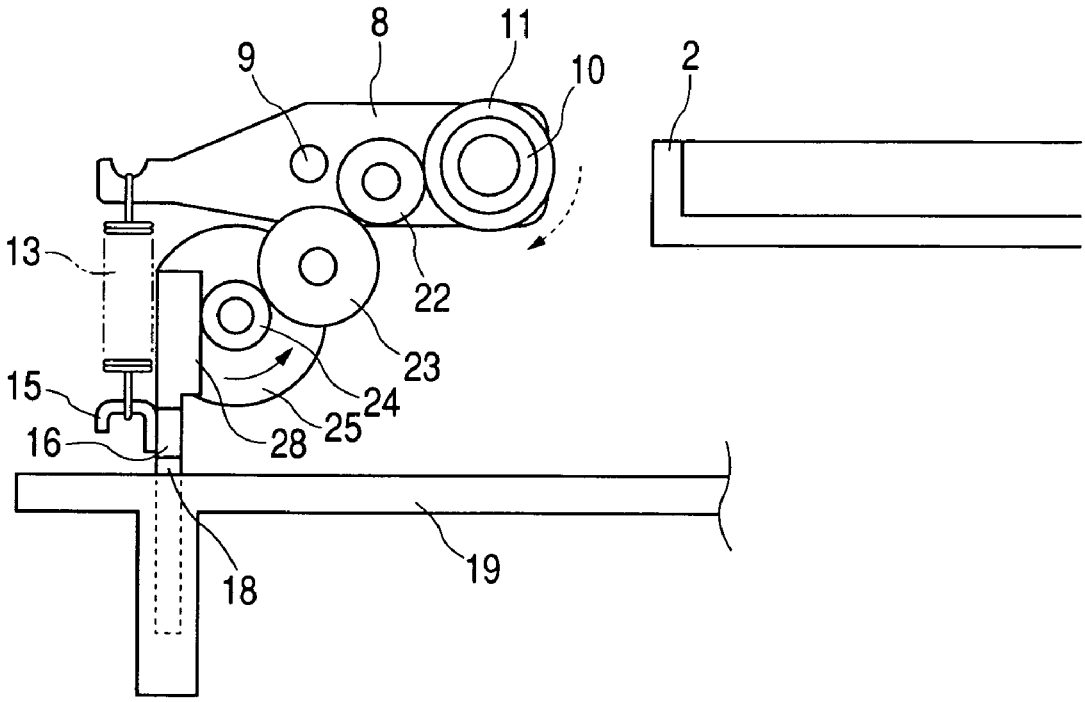
FIG. 2 is a sectional view perpendicular to the surface of a sheet midway of the sheet width shown in FIG. 1, which is observed toward the retard lever side.

FIG. 2 is a sectional view perpendicular to the surface of the sheet 1 almost midway of the sheet width shown in FIG. 1, which is observed toward the retard lever 8 side. As described above, the structure is arranged to contain the motor gear 24 to the limiter gear 11 by way of idler gears 23 and 22, that is, it is made capable of rotating the limiter gear 11 when the motor 25 is energized.

On the other hand, the motor gear 24 is also arranged to engage with the lack portion 28 provided for the slider 16, and the structure is formed so as to make the lack portion 28, or the entire body of the slider 16, movable up and down, when the motor 25 is energized. The lack portion is also arranged as another lack portion 29 on the opposite side as shown in FIG. 1 and allowed to engage with the gear 27.

In this way, by the rotation of the motor gear 24, the slider 16 moves up and down. Therefore, spring hooks 14 and 15 move up and down so that the charged amount of retard pressure springs 12 and 13 are caused to change. Thus, it becomes possible to change the contact force of the retard roller 5 against the conveying roller 4.

Figure 3:
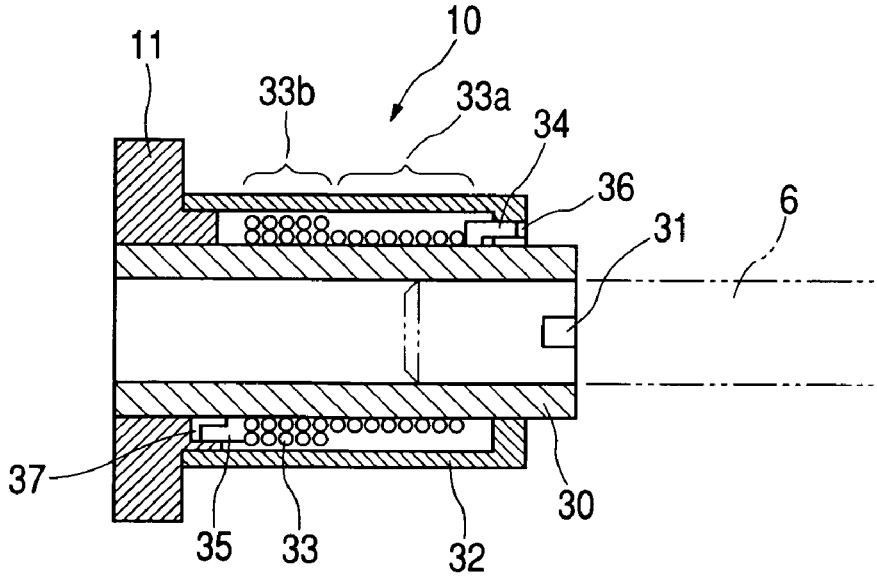
FIG. 3 is a cross-sectional view that shows a torque limiter.

Next, the description will be made of the inner structure of the torque limiter 10 in conjunction with FIG. 3, which is a cross-sectional view of the torque limiter.

To the inner race 30, the retard roller shaft 6, which is indicated by two-dot chain lines, is inserted. The inner race 30 and the retard roller shaft 6 are fixed in the rotational direction by use of a groove 31, and it is arranged to rotate the retard roller shaft 6 and the inner race 30 integrally when the spring pin, which is inserted into a hole (not shown) provided for the retard roller shaft 6, is fitted into the groove 31. The inner race 30 is axially supported by the outer case 32, which is fixed to the retard lever 8. The right end of the stepped spring 33, which is located in the outer case 32 and wound around the inner race 30, is inserted into and fixed to the end hole 36 provided for the outer case 32. The stepped spring 33 is provided with a smaller-diameter portion 33*a*, which is wound around the inner race 30 closely, and the larger-diameter portion 33*b*, which is formed with a gap to the inner race 30. The aforesaid limiter gear 11 is fitted into the outer case 32, and dually serves as a lid to prevent the stepped spring 30 from falling off. An end hole 37 is provided for the limiter gear 11, into which the left end of the stepped spring 33 on the larger-diameter 33*b* side is inserted and fixed. Since the limiter gear 11 is rotative centering on the axial center of the retard roller shaft 6, the spring-end hole 37 also rotates. With the rotation of the spring-end hole 37, the larger-diameter portion of the stepped spring 33 is displaced, and this is transmitted to the smaller-diameter portion to enable the tightening force against the inner race 30 to be changed. As a result, the rotating-load torque of the inner race 30 is allowed to change. Consequently, the rotating-load torque of the retard roller 5 is caused to change.

Figure 12:
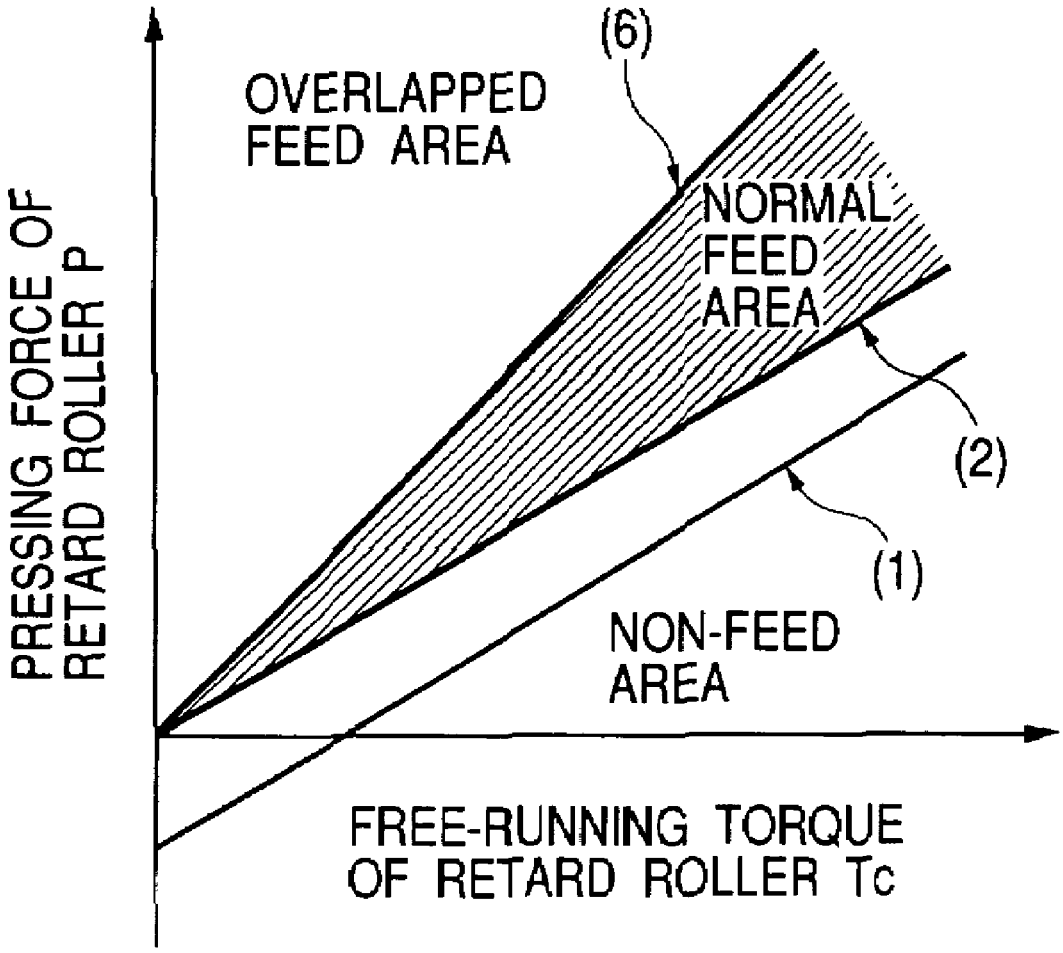
FIG. 12 is a graphic view that shows the pressing force P of the retard roller, and the free-running torque Tc of the torque limiter as parameters.

With the structure arranged as described above, it becomes possible to change the pressurized contact force of the retard roller 5 against the conveying roller 4, and the rotating-load torque of the retard roller 5 simultaneously. The changing orientation is arranged so that the larger the pressurized contact force, the larger becomes the rotating-load torque. The reasons: as clear from FIG. 12, which shows the dynamical relations in the form of a graph, the normal area of sheet feed and conveyance is made larger when the condition is set in the direction in which both the pressurized contact force of the retard roller 5 against the conveying roller 4 and the rotating-load torque of the retard roller 5 are made larger. Thus the stable feed and conveyance are made possible.

Figure 4:
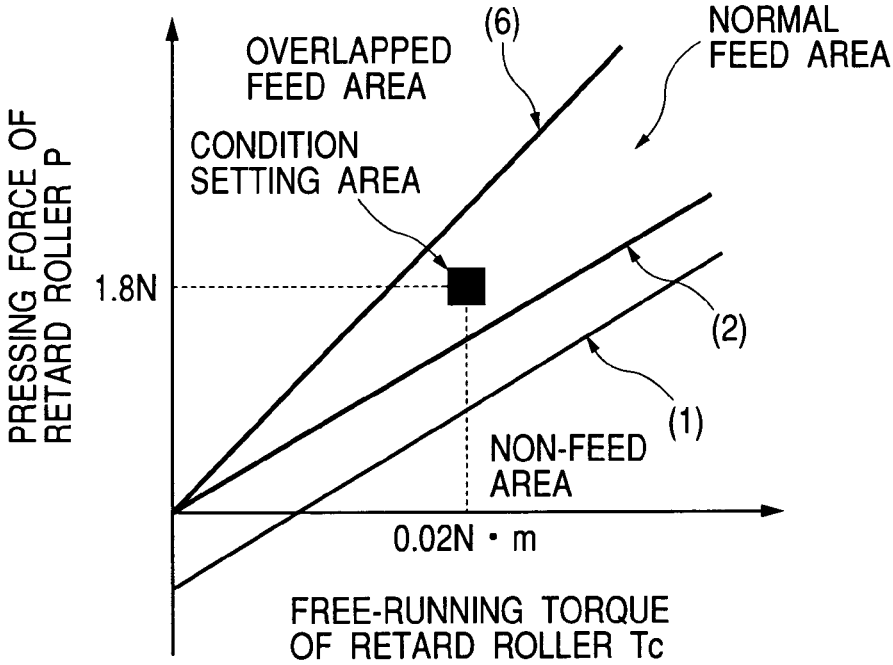
FIG. 4 is a graphic view that shows the dynamical relations for a normal sheet.
Figure 5:
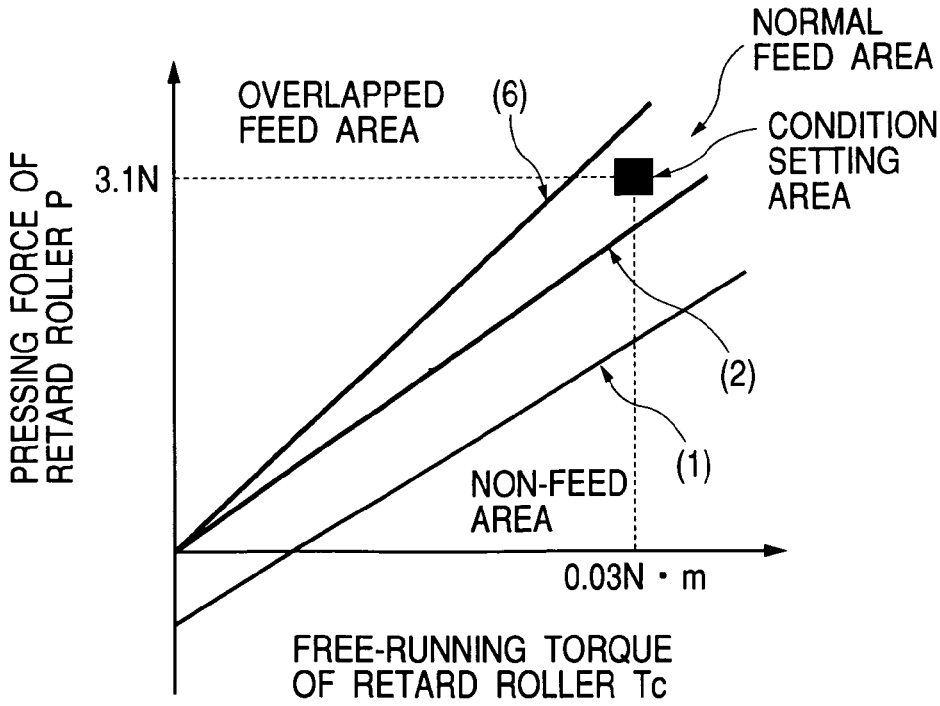
FIG. 5 is a graphic view that shows the dynamical relations for a glossy sheet.

FIG. 4 is a graphical view of the dynamical relations with respect to the normal sheet. FIG. 5 is a graphical view of the dynamical relations with respect to the glossy sheet used for ink jet recording. In general, the glossy sheet used for ink jet recording is provided with an ink acceptance layer on the surface thereof. Therefore, the surface is easier to absorb moisture, and the sheets of such kind tend to stick to each other. Therefore, the friction coefficient between the sheets becomes larger than that between the normal sheets. Also, the friction coefficient between the surface rubber of the feed and conveying roller and the surface of the sheet tends to be equal to or slightly smaller than that of the normal sheet. As a result, when the relations represented in FIG. 4 and FIG. 5 are compared, the normal area of feed and conveyance becomes narrower for the glossy sheet shown in FIG. 5, and the occurrence of double feed or disabled feed becomes more frequent. Therefore, it is understandable that when the glossy sheet is used for recording, the pressurized contact force against the conveying roller 4, and the rotating-load torque of the retard roller 5, are both conditioned to be in the direction to make them larger so as to enable the wider area of the normal feed and conveyance to be used as much as possible for obtaining a better result.

However, for a normal sheet, it is desirable to set a lower pressurized contact force and rotating-load torque than those given to a glossy sheet in consideration of the durability of the retard roller 5, because the area of normal feed and conveyance is wider as shown in FIG. 4.

More specifically, the setting is made as follows:

Condition set for using a normal sheet: Pressure 1.8 N, and rotating-load torque 0.02 N•m Condition set for using a glossy sheet: Pressure 3.1 N, rotating-load torque 0.03 N•m Actually, however, there occur errors in the pressurized contact force and the rotating-load torque due to the variations of parts, and the settings are made within each range centering on each of the aforesaid values, which is indicated with the square in FIG. 4 and FIG. 5, respectively.

As operating means for indicating the rotational amount of the motor 25, any means should be effectively applicable if only the user is able to select it by use of the selection buttons for the kind of sheet to be used, which is provided for the main body of a recording apparatus (not shown) or from indication means, such as an LCD provided for a recording apparatus.

Also, regarding the combination of selected pressurized contact force and the rotating-load torque, it should be good enough if only the number of combinations is determined depending on the kinds of sheet material that a particular recording apparatus can handle or the magnitude of difference between the characteristics of the sheets to be used. There is no need for making it possible to select any one of all the combinations in which all kinds of sheet material are combined with each other, respectively. For the present embodiment, it is determined that the sheet feeding can be executed normally for all kinds of sheets only with the two combinations. In this case, if only the phase of the motor gear 24 can be determined to be either one of the two positions by use of an optical sensor (not shown) or the like, it is easy to make switching between them.

Figure 6:
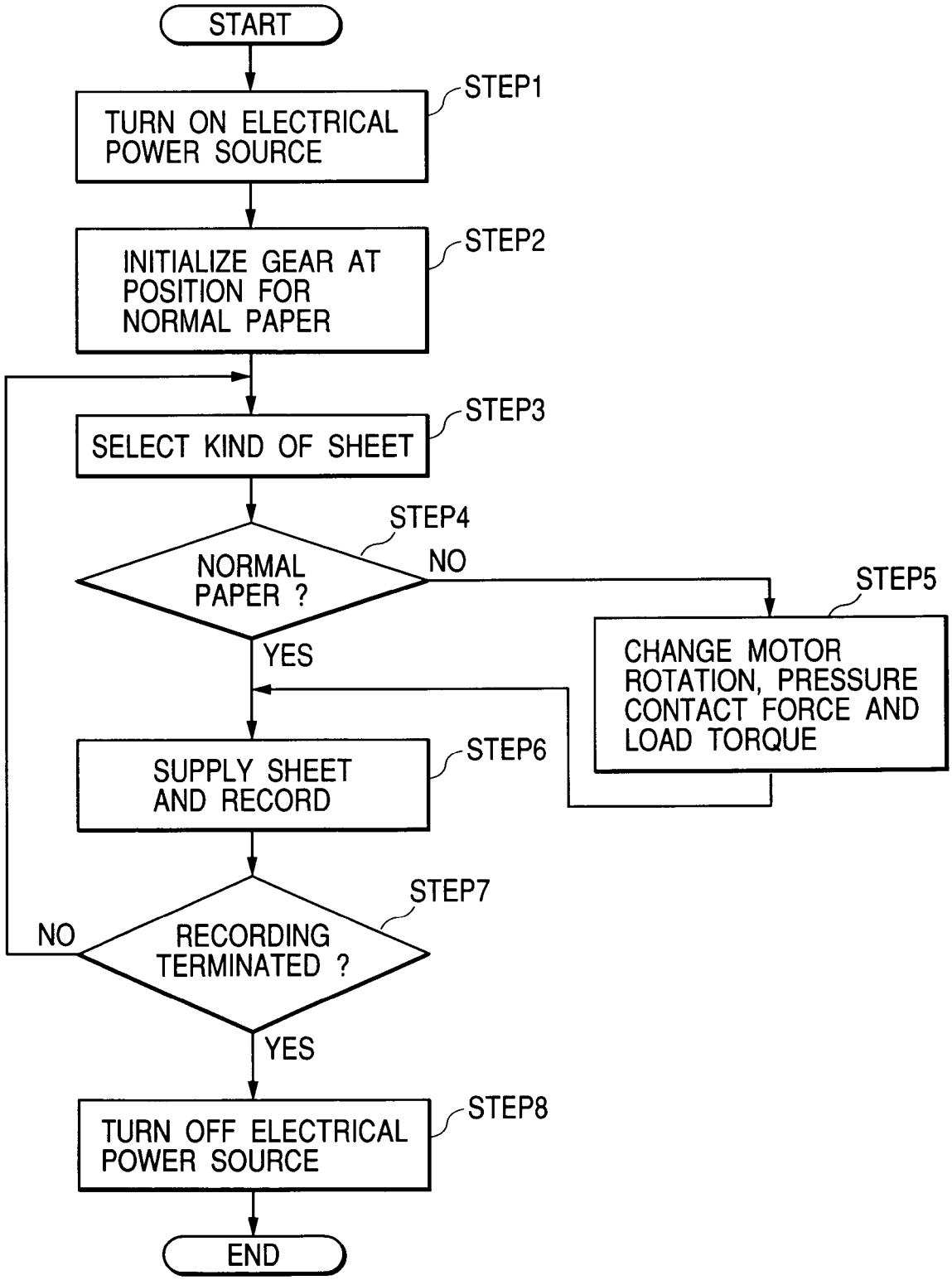
FIG. 6 is a flowchart that illustrates the operation of pressure and rotational-load torque selection.

Now, hereunder, the description will be made of the selecting operation of the pressurized contact force and the rotating-load torque in conjunction with a flowchart shown in FIG. 6.

At first, in Step 1, the electric source supply is turned on. In Step 2, the output of a sensor (not shown), which detects the gear phase, is examined in order to set the pressurized contact force and the rotating-load torque for use of a normal sheet. Thus, initialization is carried out. More specifically, while the output of the sensor is being monitored, the motor 25 is caused to rotate regularly or reversely, and it stops when the sensor confirms that the motor gear 24 presents the predetermined phase. If the motor 25 is a pulse motor, such phase is kept by energizing it or if the resistance of the gear train is large, the gear phase is kept with the motor being turned off without energizing it.

Next, in Step 3, the sheet is selected. In Step 4, it is determined whether or not the selected sheet is a normal sheet. If it is found to be a normal sheet, the sheet feeding and recording are executed as it is in Step 6. If it is found to be a glossy sheet or the like, not a normal sheet, the motor 25 is energized in Step 5 to enable the motor to rotate for a predetermined amount, thus changing the pressurized contact force and the load torque. In Step 7, it is determined whether or not the recording is completed. If negative, the process returns to the Step 3 where a sheet is selected, and the same flow is repeated. If affirmative, the electric source supply is turned off in Step 8 to end the operation.

Here, for the present embodiment, the torque limiter, which utilizes the tightening force of spring, is adopted, but the magnetic type limiter, which is capable of changing torque by the intensity of magnetic power, or the slip type limiter, that uses the friction force generated when sheet materials themselves are caused to be in contact under pressure, and changes torque with changes in the pressurized contact force, or any others are equally usable for the present invention if only the type of a limiter used should be able to change the rotating-load torque.

Also, for the variability of pressurized contact force of the retard roller 5 against the conveying roller 4, besides the tensioning spring, a compression spring, a screw-recoiling spring, or the like is also usable. Also, it may be possible to change the pressurized contact force by means of electromagnetic force or the like other than the use of spring.

Also, in accordance with the embodiment described above, both the pressurized contact force of the retard roller 5 against the conveying roller 4, and the rotating-load torque of the retard roller 5 are changed. The embodiment is not necessarily limited thereto. Depending on the setting of conditions, there is a case where the normal sheet feeding can be implemented with either one of them being made variable.

In addition, in the case of an ink jet recording apparatus, it is often arranged to provide means, such as a lever, for changing the distance between the ink jet recording head and the surface of medium in accordance with the thickness of a sheet to be used. If the structure is arranged so that interlocked with this means for making the distance variable, the pressurized contact force and rotating-load torque are allowed to change accordingly, there is no need for effectuating individual setting. Thus, it is made possible to materialize an apparatus excellent in operability, and also, capable of performing sheet feeding stably.

Second Embodiment

Figure 7:
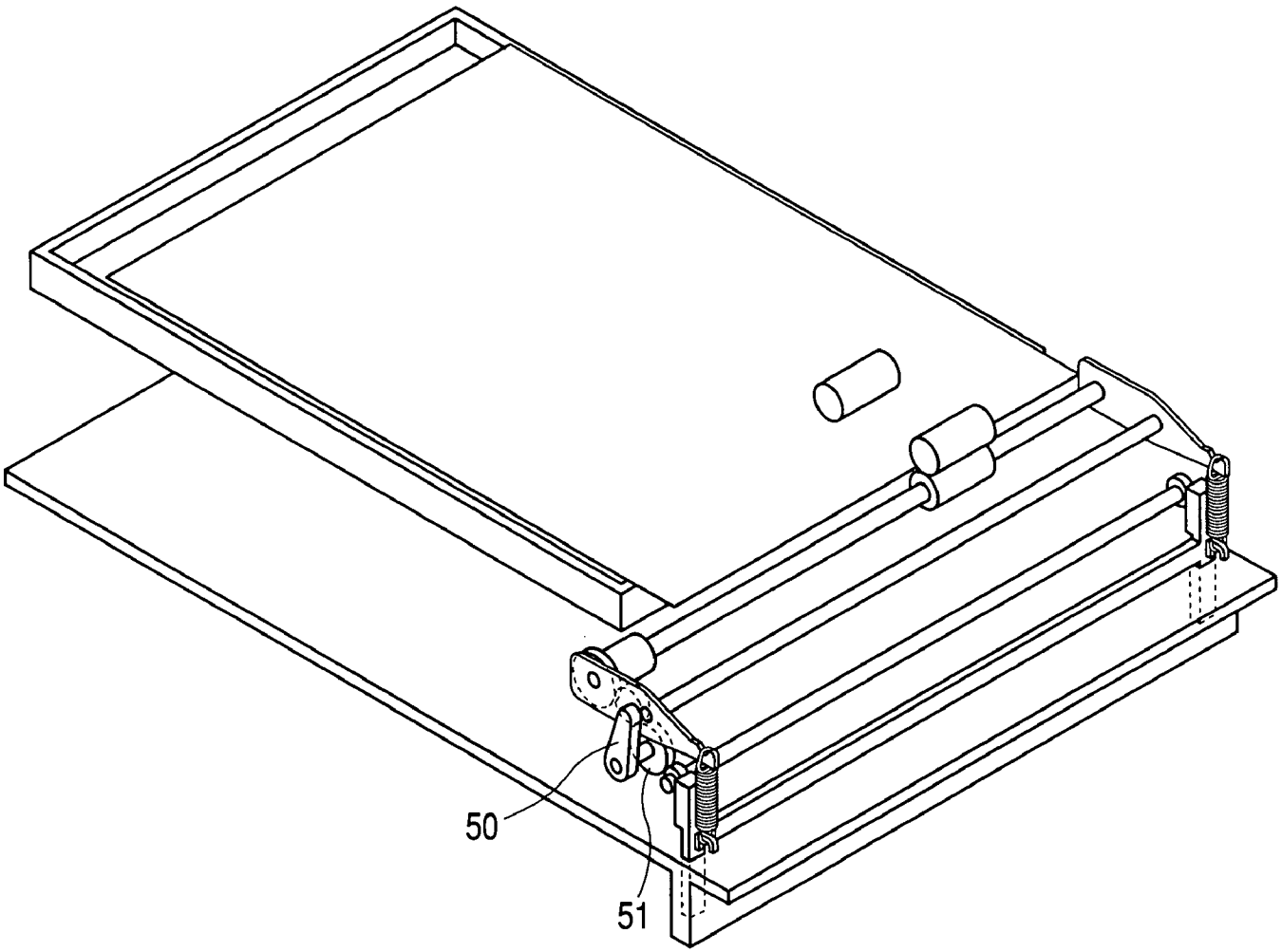
FIG. 7 is a perspective view that shows a recording apparatus in accordance with a second embodiment of the present invention.
Figure 8:
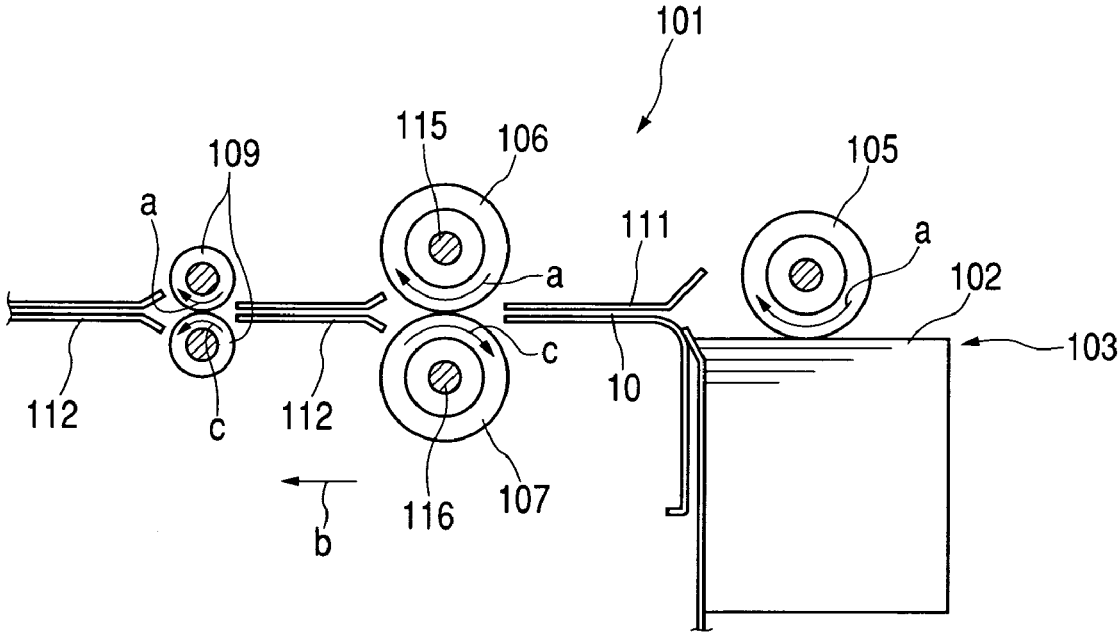
FIG. 8 is a side view that shows one conventional example of the sheet feeding and separation device that adopts the retard method.
Figure 9:
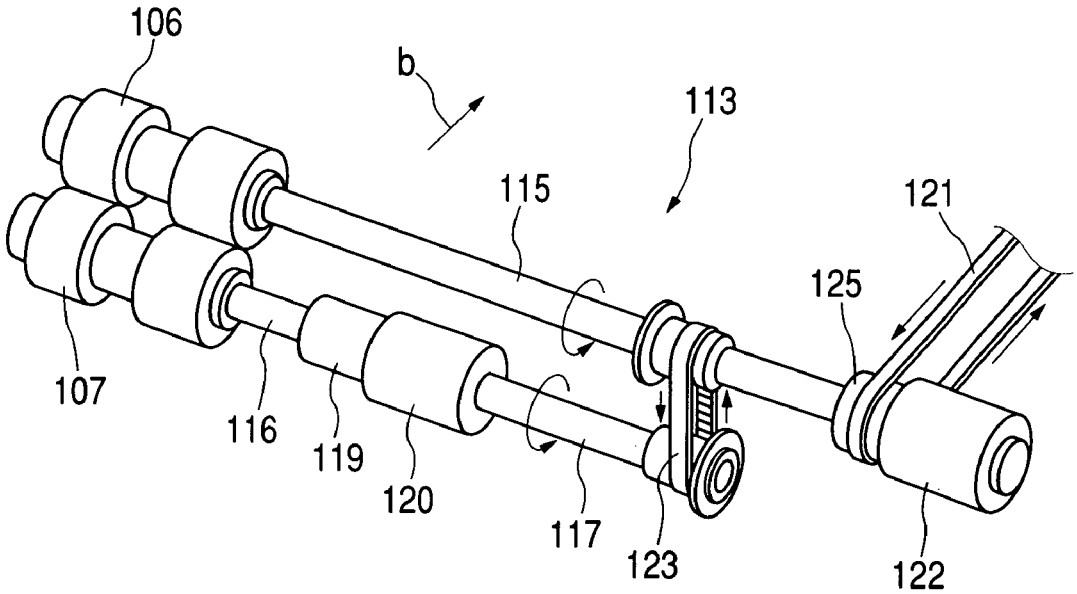
FIG. 9 is a perspective view that shows one conventional example of the driving transmission device.
Figure 10:
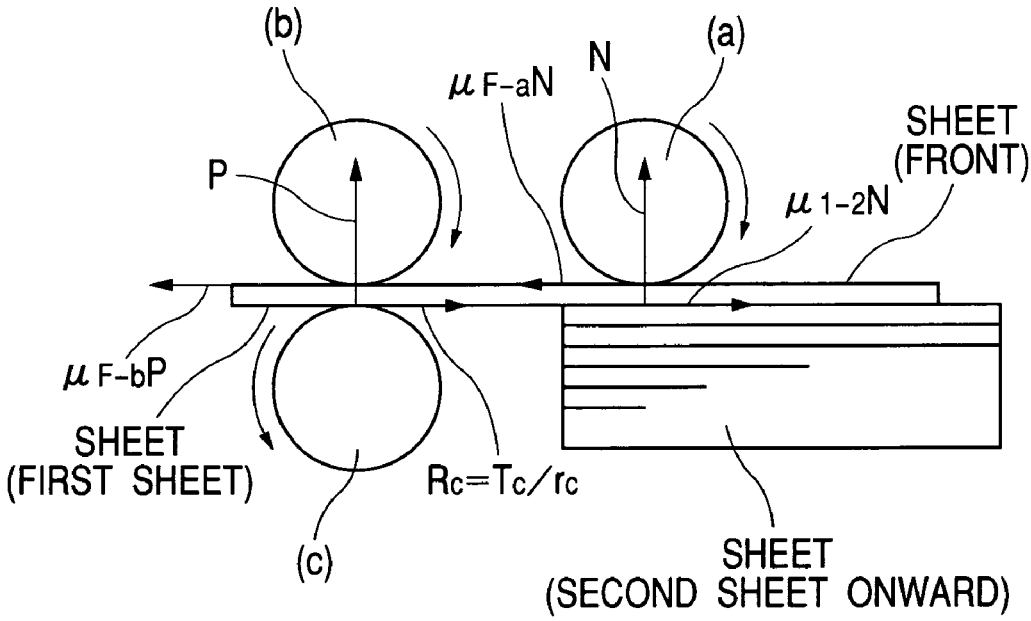
FIG. 10 is a view that represents the dynamic model when only one sheet of medium enters the separating portion.
Figure 11:
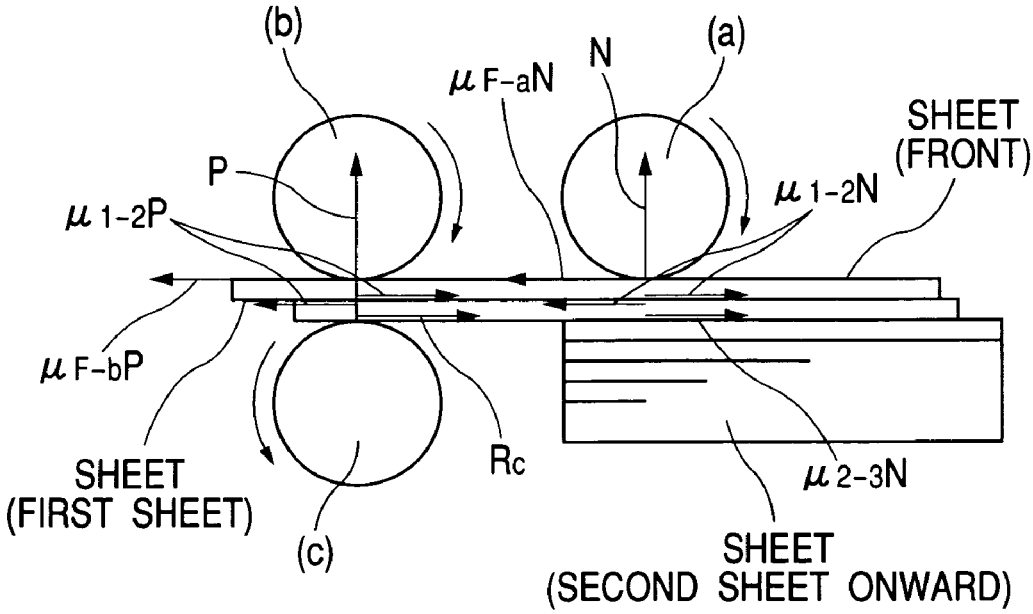
FIG. 11 is a view that represents the dynamic model when two sheets of medium enter the separating portion.

FIG. 7 is a perspective view that shows the entire body of a recording apparatus in accordance with the present embodiment.

In FIG. 7, the description will be omitted for the portions having the same functions as those of the first embodiment. Only the different portions will be described.

The lever 50, which is arranged to protrude from the outer case (not shown) of the recording apparatus, is capable of executing positioning at the left and right positions. Also, an idler gear 51 is arranged to rotate corresponding to the position of the lever 50. As in the case of the first embodiment, both the pressurized contact force of the retard roller 5 against the conveying roller 4 and the rotating-load torque of the retard roller 5 are made variable corresponding to the phase of the idler gear 51. Therefore, it becomes possible to perform sheet feeding stably for various kinds of medium without using an actuator, such as a motor.

Third Embodiment

It is a prerequisite to arrange the medium setting provision for a printer driver, which is installed on a host apparatus represented by a personal computer, because it is related to the setting of the ink-discharge amount or the recording mode of an ink jet recording apparatus.

Therefore, if it is arranged to transmit the information regarding the medium setting at that time, and then, to change the pressurized contact force against the conveying roller 4 and the rotating-load torque of the retard roller 5 in accordance with the information thus transmitted, there is no need for making the changes of the sheet-feeding conditions separately from the setting of other aspects, such as the recording mode. As a result, a recording system having excellent operability can be materialized.

As described above, in accordance with one aspect of the invention, the sheet material conveying apparatus, which is provided with sheet material holing means for stacking and holding plural sheets of recording material, a driving roller for feeding and conveying the sheet material, and a driven roller to be in contact with the driving roller under pressure exerted by a constant load to follow the rotation thereof, to convey sheet material one by one after separating it by the driving roller and the driven roller from those stacked and held by sheet material holding means, comprises a torque limiter having means for changing load torque to provide rotating-load torque when the driving roller rotates in the conveying direction of the sheet material, and to change the rotating-load torque thus generated, and operating means capable of operating the sheet material conveying means from the outside for controlling the rotating-load torque generated by the load torque changing means.

The sheet material conveying apparatus of the present invention structured as described above is capable of changing the rotating-load torque so as to be in agreement with the optimal condition of conveyance, which is changeable depending on the kind of sheet material and other factors, thus making it possible to materialize the sheet material conveying apparatus, which is able to convey various kinds of many sheet materials stably.

In accordance with another aspect of the invention, it is made possible to select plural steps of rotating-load torque by operating means. Therefore, the rotating-load torque can be selected corresponding to the condition of the kind of sheet material and other factors. Thus, it becomes possible to materialize a sheet material conveying apparatus capable of conveying various kinds of many sheet materials stably with excellent operability.

In accordance with a further aspect of the invention, the lever, which is movable to plural positions, is provided as operating means for selecting the rotating-load torque corresponding to the conditions of the kind of sheet material and other factors. Therefore, it is made possible to materialize a sheet material conveying apparatus capable of conveying various kinds of many sheet materials stably with excellent operability at low costs.

In accordance with yet another aspect of the invention, a torque limiter comprises an inner race shaft that forms a part of a driven roller shaft, a spring wound around the outer circumference of the inner race shaft, and means for changing load torques provided with a first spring-end fixing portion that fixes one end of the spring, and a second spring-end fixing portion that fixes the other end of the spring, being structured to rotate the second spring-end fixing portion by its own rotation with the inner race shaft as the center of rotation. Then, the arrangement is made to make it possible to rotate the means for changing load torques by use of operating means. Therefore, by changing the tightening force of the spring, the rotating-load torque can be changed, hence making it possible to materialize a small and inexpensive sheet material conveying apparatus capable of conveying various kinds of many sheet materials with excellent operability.

In accordance with a still further aspect of the invention, means for changing load torques is provided with a first actuator that provides rotational force, and a first driving transmitting means that transmits the driving power of the first actuator to the means for changing load torques. Thus, with the actuator being energized for driving, the degree of freedom in setting the position of the means for changing load torques is increased, while being combined with a sensor for detecting the phase of means for changing load torques directly or indirectly, it is made possible to initialize the load torque. With the structure thus arranged, it becomes possible to materialize a sheet material conveying apparatus capable of conveying various kinds of many sheet materials stably with higher reliability, because any possible danger of unfavorable influence exerted on the sheet conveyance or on the durability of the device is reduced, which may otherwise occur if the user forgets returning the setting of the load torque to the initial stage.

In accordance with another aspect of the invention, means for changing loads, which changes the contact load between the driving roller and driven roller, is provided to make it possible to change the contact load in addition to the rotating-load torque by controlling with operating means the pressurized contact load generated by the means for changing loads so as to be in agreement with the optimal condition of conveyance that may change depending on the kinds of sheet material and other factors. Thus, it is made possible to materialize a sheet material conveying apparatus capable of conveying various kinds of many sheet materials in a wider range.

In accordance with yet another aspect of the invention, operating means is arranged to be able to select the combinations between plural steps of rotating-load torques and pressurized contact loads. Then, the rotating-load torque can be selected corresponding to the conditions of the kind of recording medium and other factors to make it possible to materialize a sheet material conveying apparatus capable of conveying various kinds of many sheet materials stably with excellent operability.

In accordance with a further aspect of the invention, the structure is arranged so that means for changing loads is provided with the pressing spring that presses the driving roller and driven roller to be in contact with each other under pressure, and means for changing the loads to be generated by the pressing spring. As a result, it becomes possible to change the rotating-load torques and pressurized-contact loads to be in agreement with the optimal condition of conveyance that may change depending on the kind of sheet material and other factors. There is no need for the adoption of any large-scale electric type torque limiter and means for changing loads. Thus, it becomes possible to materialize a small and inexpensive sheet material conveying apparatus capable of conveying various kinds of many sheet materials with excellent operability.

In accordance with yet another aspect of the invention, the structure is arranged so that means for changing loads is provided with a second actuator that gives driving power, and second driving transmitting means that transmits the driving power of the second actuator to the means for changing loads. Therefore, with each of the actuators being energized for driving, the rotating-load torques and the pressurized-contact loads can be changed so as to increase the degree of freedom in setting the position of the means for changing load torques, while being combined with a sensor for detecting the phase of means for changing load torques directly or indirectly, it is made possible to initialize the load torque. With the structure thus arranged, it becomes possible to materialize a sheet material conveying apparatus capable of conveying various kinds of many sheet materials stably with higher reliability, because any possible danger of unfavorable influence exerted on the sheet conveyance or on the durability of the device is reduced, which may otherwise occur if the user forgets to return the setting of the load torque to the initial stage.

In accordance with a still further aspect of the invention, a first actuator and a second actuator are shared for use. Therefore, a highly reliable-sheet material conveying apparatus capable of conveying various kinds of many sheet materials stably can be materialized at lower costs.

In accordance with still another aspect of the invention, a recording apparatus provided with an ink jet recording head for discharging ink, which records recording information by recording means on a sheet material serving as a recording medium, comprises a sheet material conveying apparatus of the present invention, and means for changing the distance between the surface of the ink jet head facing the surface of the recording medium where recording is being made. Then, operating means controls the means for changing distances. As a result, the optimal rotating-load torque, pressurized-contact load, and distance to the surface of the recording medium can be set in accordance with the kind of recording medium. There is no need for performing each individual setting. Thus, it is made possible to materialize a recording apparatus capable of feeding and conveying various kinds of many sheets of recording medium stable with excellent operability.

In accordance with yet a further aspect of the invention, a recording system of the present invention, which controls recording by the recording apparatus of the present invention, comprises a host apparatus that transmits recording commands to the recording apparatus, designating means that designates the kind of recording medium on the host apparatus, transmitting means that transmits to the recording apparatus the information of recording medium thus designated, and controlling means that controls the rotating-load torque generated by means for changing load torques in accordance with the information of the recording medium thus transmitted. Therefore, the rotating-load torque can be set on the host apparatus in accordance with the medium designation. There is no need for setting the sheet-feeding conditions individually. Hence, it is made possible to materialize a recording apparatus capable of stably performing sheet feeding for various kinds and many sheets of recording medium with excellent operability.

In accordance with yet another aspect of the invention, it is possible to materialize a recording apparatus capable of stably performing sheet feeding with excellent operability for various kinds and many sheets of recording medium, because controlling means controls the pressurized-contact load provided by means for changing loads so as to be able to set on the host apparatus the rotating-load torque and the pressurized-contact load in accordance with the medium designation.

As described above, in accordance with the present invention, the pressurized-contact load between a driving roller and a driven roller, and the rotating-load torque of the driven roller can be changed in agreement with the sheet material serving as a recording medium. Therefore, while attempting the provision of longer life for rollers, it is made possible to prevent double feeding of sheet material.

What is claimed is:

1. A sheet material conveying apparatus comprising:

holding means for holding a plurality of sheet materials;

a feeding roller for feeding a sheet material held by said holding means;

a driving roller for conveying the sheet material fed by said feeding roller;

a driven roller to be in contact with said driving roller under pressure to follow the rotation thereof, wherein sheet materials fed by said feeding roller are separated one by one by said driving roller and said driven roller;

a torque limiter for providing rotating load torque for said driven roller when said driven roller rotates in the conveying direction of the sheet material;

load torque changing means for changing the rotating load torque provided by said torque limiter; and operating means for operating said load torque changing means so that said load torque changing means changes the rotating load torque provided by said torque limiter.

2. A sheet material conveying apparatus according to claim 1, wherein said load torque changing means changes the rotating load torque provided by said torque limiter among plural steps of rotating load torque.

3. A sheet material conveying apparatus according to claim 2, wherein said operating means comprises a lever movable to plural positions.

4. A sheet material conveying apparatus according to claim 1, wherein said torque limiter is provided with an inner race shaft forming a part of a shaft of said driven roller and a spring wound around the outer circumference of said inner race shaft and said load torque changing means comprises a first spring-end fixing portion for fixing one end of said spring, and a second spring-end fixing portion for fixing the other end of said spring, and is structured to rotate said second spring-end fixing portion by its own rotation with said inner race shaft as the center of rotation, and said load torque changing means is made rotative by said operating means.

5. A sheet material conveying apparatus according to claim 4, further comprising:

a load torque actuator for providing said load torque changing means with rotational force; and load torque driving transmitting means for transmitting the driving power of said load torque actuator to said load torque changing means.

6. A sheet material conveying apparatus according to claim 1, further comprising:

load changing means for changing a pressurized-contact load between said driving roller and said driven roller, wherein said operating means controls the pressurized-contact load generated by said load changing means.

7. A sheet material conveying apparatus according to claim 6, wherein said load changing means changes the pressurized-contact load among plural steps of the pressurized-contact load.

8. A sheet material conveying apparatus according to claim 6, wherein said load changing means is provided with a pressing spring for pressing said driving roller and said driven roller to be in contact with each other, and means for changing loads generated by said pressing spring.

9. A sheet material conveying apparatus according to claim 6, further comprising:

a load actuator for providing said load changing means with driving power; and load driving transmitting means for transmitting the driving power of said load actuator to said load changing means.

10. A sheet material conveying apparatus according to claim 9, further comprising:

a load torque actuator for providing said load torque changing means with rotational force; and load torque driving transmitting means for transmitting the driving power of said load torque actuator to said load torque changing means, wherein said load torque actuator and said load actuator are shared for use.

11. A recording apparatus provided with an ink jet recording head for discharging ink to record recording information by recording means on a sheet material serving as a recording medium, said apparatus comprising:

a sheet material conveying apparatus according to any one of claim 1 to claim 10; and distance changing means for changing the distance between the surface of the ink jet recording head facing the surface of the recording medium and the surface of the recording medium, wherein said operating means is capable of operating said distance changing means.

12. A recording system for controlling recording on a recording medium by a recording apparatus according to claim 11, comprising:

a host apparatus for transmitting recording commands to said recording apparatus;

designating means for designating the kind of recording medium in said host apparatus;

transmitting means for transmitting to said recording apparatus the information of the designated kind of recording medium; and controlling means for controlling said load torque changing means so that the rotating load torque generated by said torque limiter is changed in accordance with the information of the designated kind of recording medium transmitted by said transmitting means.

13. A recording system for controlling recording on a recording medium by a recording apparatus, wherein said recording apparatus is provided with an ink jet recording head for discharging ink to record recording information by recording means on a sheet material serving as a recording medium, said recording apparatus comprising:

a sheet material conveying apparatus according to claim 6; and distance changing means for changing the distance between the surface of the ink jet recording head facing the surface of the recording medium and the surface of the recording medium, wherein said operating means is capable of operating said distance changing means;

wherein said recording system comprising:

a host apparatus for transmitting recording commands to said recording apparatus;

designating means for designating the kind of recording medium in said host apparatus;

transmitting means for transmitting to said recording apparatus the information of the designated kind of recording medium; and controlling means for controlling said load torque changing means so that the rotating load torque generated by said torque limiter is changed in accordance with the information of the designated kind of recording medium transmitted by said transmitting means, wherein said controlling means controls said load changing means so that the pressurized-contact load generated by said load changing means is changed in accordance with the information of the designated kind of recording medium transmitted by said transmitting means.

14. A sheet material conveying apparatus comprising:

holding means for holding a plurality of sheet materials in a stack;

a driving roller for conveying each sheet material;

a driven roller for giving resistance to a sheet material conveyed by said driving roller to retard the progress of the sheet material not to be in contact with said driving roller;

a torque limiter for providing rotating load torque when said driven roller rotates in a sheet conveying direction;

biasing means for biasing said driven roller to be in contact with said driving roller under pressure; and controlling means for changing at least one of the rotating load torque of said torque limiter and the biasing force of said biasing means.

15. A sheet material conveying apparatus according to claim 14, further comprising designating means for designating the kind of recording medium, wherein said controlling means changes at least one of the rotating load torque and the biasing force of said biasing means in accordance with the kind of sheet designated by said designating means.

* * * * *